US008133107B2

(12) United States Patent
Bailey et al.

(10) Patent No.: US 8,133,107 B2
(45) Date of Patent: Mar. 13, 2012

(54) METHODS AND DEVICES FOR OPERATING A MODIFIED BINGO GAME

(75) Inventors: Shaun Bailey, N. Las Vegas, NV (US); Weldon L. Russell, Las Vegas, NV (US)

(73) Assignee: NP IP Holdings LLC, Las Vegas, NV (US)

( * ) Notice: Subject to any disclaimer, the term of this patent is extended or adjusted under 35 U.S.C. 154(b) by 1127 days.

(21) Appl. No.: 11/999,544

(22) Filed: Dec. 4, 2007

(65) Prior Publication Data

US 2009/0143129 A1 Jun. 4, 2009

(51) Int. Cl.
*A63F 3/06* (2006.01)

(52) U.S. Cl. ..... 463/19; 273/269

(58) Field of Classification Search ..... 463/16–20; 273/269

See application file for complete search history.

(56) References Cited

U.S. PATENT DOCUMENTS

| | | | | |
|---|---|---|---|---|
| 1,655,380 | A | 1/1928 | Parker | |
| 3,589,729 | A | 6/1971 | Girard | |
| 4,019,744 | A | 4/1977 | Pizur, Sr. | |
| 4,252,322 | A * | 2/1981 | Orter | 273/269 |
| 5,029,871 | A | 7/1991 | Willson, Jr. et al. | |
| 5,127,656 | A | 7/1992 | Simpson | |
| 5,338,042 | A | 8/1994 | Greer | |
| 5,351,970 | A | 10/1994 | Fioretti | |
| 5,160,146 | A | 4/1996 | Greer | |
| 5,569,083 | A | 10/1996 | Fioretti | |
| 5,624,119 | A * | 4/1997 | Leake | 273/269 |
| 5,727,786 | A * | 3/1998 | Weingardt | 273/269 |
| 5,823,534 | A | 10/1998 | Banyai | |
| 6,080,061 | A * | 6/2000 | Watanabe et al. | 463/16 |
| 2007/0259709 | A1 * | 11/2007 | Kelly et al. | 463/20 |
| 2008/0032782 | A1 * | 2/2008 | Boesen et al. | 463/20 |
| 2008/0248863 | A1 * | 10/2008 | Seymour et al. | 463/21 |

OTHER PUBLICATIONS

File History of U.S. Patent No. 5,482,289, issued Jan. 9, 1996 to Weingardt.
File History of U.S. Patent No. 5,727,786, issued Mar. 17, 1998 to Weingardt.
File History of U.S. Patent No. 6,565,091, issued May 20, 2003 to Weingardt.
MPI Family Report for U.S. Patent No. 5,482,289 dated May 21, 2008, 20 pages.
MPI Family Report for U.S. Patent No. 5,727,786 dated Jan. 14, 2008, 18 pages.

(Continued)

*Primary Examiner* — Peter DungBa Vo
*Assistant Examiner* — Nicholas Ditoro
(74) *Attorney, Agent, or Firm* — Milbank Tweed Hadley & McCloy LLP

(57) ABSTRACT

Aspects of the present inventions concern methods and devices for operating a Bingo game. Such aspects include: assigning to each of a first set of real or virtual balls a number selected from a group within a predetermined numerical sequence; assigning a non-numerical designation to only a second set of real or virtual balls within the predetermined numerical sequence, wherein the second set of real or virtual balls is a subset of the first set of real or virtual balls; providing each of one or more players with at least one real or virtual player card having a randomly assigned field of spaces each space of which includes a number within the predetermined numerical sequence given for the first set of real or virtual balls, wherein there are fewer spaces than numbers in the predetermined numerical sequence.

20 Claims, 3 Drawing Sheets

OTHER PUBLICATIONS

MPI Family Report for U.S. Patent No. 6,565,091 dated May 22, 2008, 4 pages.
Scarne's Complete Guide to Gambling, John Scarne, pp. 182-199, "Bingo: The $2 Billion National Pastime", Simon and Schuster, New York, 1961.
Scarne's Complete Guide to Gambling, John Scarne, pp. 432-441, "Race Horse Keno", Simon and Schuster, New York, 1961.
Scarne's New Complete Guide to Gambling, John Scarne, pp. 205-223, "Bingo: The $3 Billion National Pastime", Simon and Schuster, New York, 1986.

* cited by examiner

METHODS AND DEVICES FOR OPERATING A MODIFIED BINGO GAME

FIELD OF THE INVENTION

The present invention relates to a modified version of Bingo, and in particular, to a version of Bingo with enhanced payouts, betting options, or winning possibilities.

BACKGROUND OF THE INVENTION

Bingo is a well-known game of chance often played outside of a casino setting, although certain casinos offer the game of Bingo or a variant of it.

Bingo is typically played with a set of balls, or objects representing balls, that are numbered 1 through 75. The numbers are divided into subsets as follows: numbers 1 through 15 are divided into the "B" group; numbers 16-30 are divided into the "I" group; numbers 31-45 are divided into the "N" group; numbers 46-60 are divided into the "G" group; and numbers 61-75 are divided into the "O" group. The balls are traditionally placed in a "hopper"—or another device that randomly calls balls or objects representing balls—which a game administrator operates.

Bingo is often played in a Bingo hall or in a similar section of a casino. It can be played through a computerized environment, in person, or through a combination of both. A player may typically buy in with a fixed amount in exchange for a bingo "card" and a player purchases as many cards as the player wishes to purchase.

In traditional Bingo, a card has a table with six rows and five columns of cells. The top row has column labels corresponding to each subset, i.e., respectively, "B", "I", "N", "G", and "O". Each column's cell includes a random sample of each subset of numbers that are grouped with the column label. For example, the "B" column typically is filled with numbers ranging from 1 through 15.

The rules of conventional Bingo are known to a person skilled in the art. Balls are usually called one at a time by the game administrator until a player achieves the predetermined winning sequence(s). Such winning sequences may include having a players card with numbers matching the ones that the game administrator called in the form of a pattern, such as a row, a column, an "S"-shape, an "X"-shape, a "T"-shape, all four corners, a "picture frame," or all cells. In traditional Bingo, the winning player receives a prize according to the prize amount designated for the winning card. Prizes may or may not be split among simultaneously winning players. The house may take a portion of the buy-in proceeds and use the remaining buy-in amount for the accrual of jackpots or other secondary games.

It may be beneficial to have a new method and device for playing Bingo where enhanced payouts, betting options, or winning possibilities exist. It also may be beneficial to have a new method of playing Bingo that may attract additional players without introducing confusing rules.

SUMMARY OF THE INVENTION

One aspect of the present invention relates to a method of operating a Bingo game, the method includes: assigning to each of a first set of real or virtual balls a number selected from a group within a predetermined numerical sequence; assigning a non-numerical designation to only a second set of real or virtual balls within the predetermined numerical sequence, wherein the second set of real or virtual balls is a subset of the first set of real or virtual balls; providing each of one or more players with at least one real or virtual player card having a randomly assigned field of spaces each space of which includes a number within the predetermined numerical sequence given for the first set of real or virtual balls, wherein there are fewer spaces than numbers in the predetermined numerical sequence; assigning at least one subset of the spaces as a first winning criteria; randomly selecting at least one of the real or virtual balls from the first set and presenting it to the one or more players; and repeatedly and randomly selecting another one of the real or virtual balls from the first set and presenting it to the one or more players until at least one of the players indicates that the first winning criteria is satisfied. Such an aspect further includes: awarding the player a first prize corresponding to the first winning criteria; and awarding the player a second prize if the ball that caused the first winning criteria to be satisfied is among the second set of real or virtual balls, the latter prize amount being determined by the total number of real or virtual balls that both correspond to the first winning criteria and that are among the second set of real or virtual balls.

Another aspect of the present invention concerns a device for operating a Bingo game, the device includes a display, a player input interface including a bet selector, and a computer processor in communication with the display and the player input interface. In such an aspect, the processor is configured to: assign to each of a first set of virtual balls a number selected from a group within a predetermined numerical sequence; assign a non-numerical designation to only a second set of virtual balls within the predetermined numerical sequence, wherein the second set of virtual balls is a subset of the first set of virtual balls; assign each of one or more players with at least one virtual player card having a randomly assigned field of spaces each space of which includes a number within the predetermined numerical sequence given for the first set of real or virtual balls, wherein there are fewer spaces than numbers in the predetermined numerical sequence; assign at least one subset of the spaces as a first winning criteria; randomly select at least one of the virtual balls from the first set and present it to the one or more players; repeatedly and randomly select another one of the virtual balls from the first set and present it to the one or more players until the first winning criteria is satisfied for at least one of the players; award the player a first prize corresponding to the first winning criteria; and award the player a second prize if the ball that caused the first winning criteria to be satisfied is among the second set of virtual balls, the latter prize amount being determined by the total number of virtual balls that both correspond to the first winning criteria and that are among the second set of virtual balls.

BRIEF DESCRIPTION OF THE DRAWINGS

Features and other aspects of embodiments of the present invention are explained in the following description taken in conjunction with the accompanying drawings, wherein.

The drawings are exemplary, not limiting.

DETAILED DESCRIPTION OF PREFERRED EMBODIMENTS

Various embodiments of the present invention will now be described in greater detail with reference to the drawings.

Figure 1:
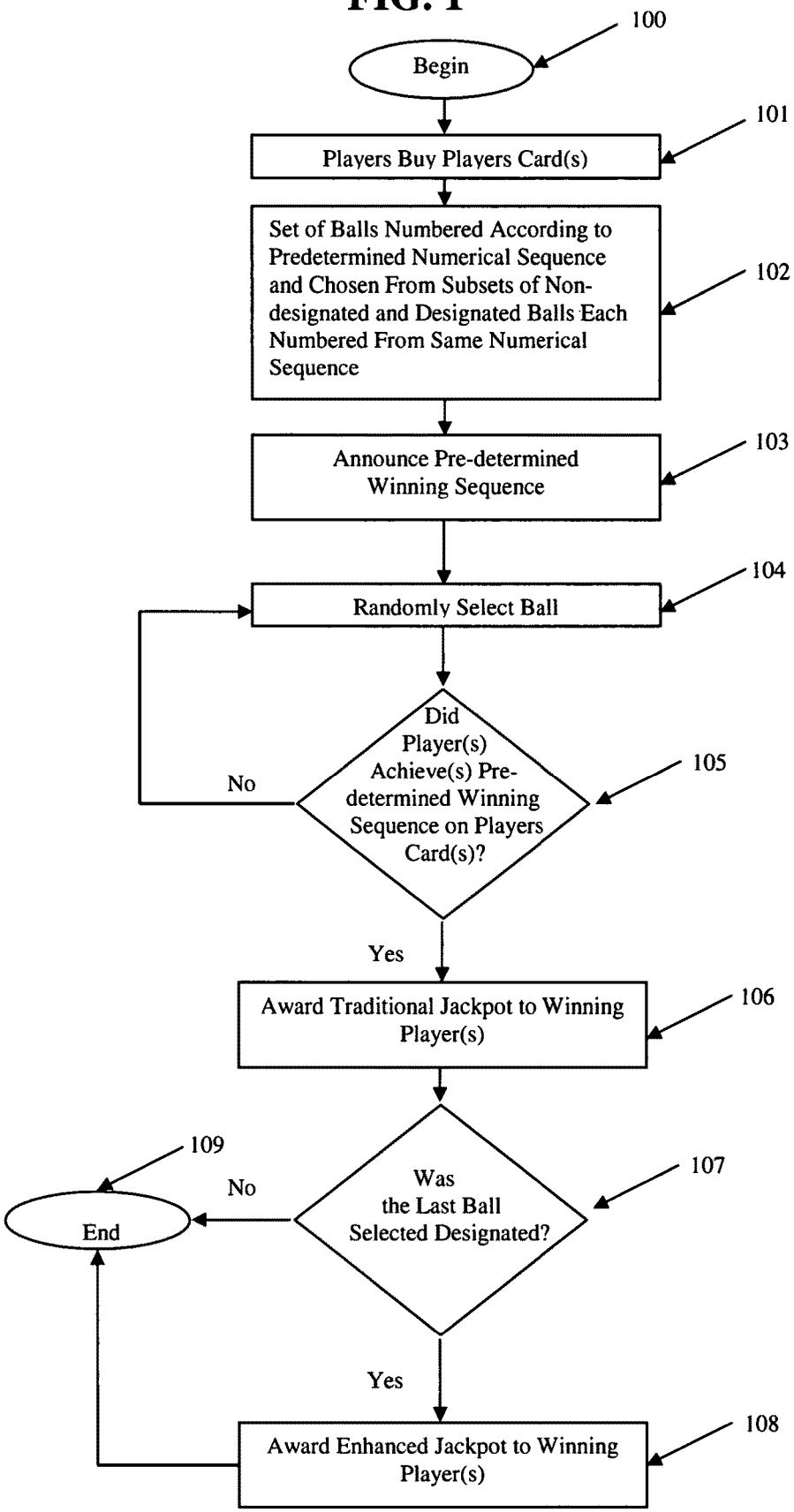
FIG. 1 illustrates a method of playing a game according to one or more embodiments of the present invention.

As shown in FIG. 1, one embodiment of the present invention includes a method of playing a game, which is a modified form of Bingo, in which each player buys at least one players card. A predetermined winning sequence is announced. A real or virtual hopper contains a set of real or virtual balls that are selected from a set of balls that are numbered from a predetermined numerical sequence, for example, 1 through 75, and another colored, or otherwise marked or designated, set of balls numbered from the predetermined numerical sequence, for example, 1 through 75. Other numerical sequences may be used and should be considered equivalents. In addition, other designations or markings may be used in lieu of a colored designation on a set of balls, such as, by way of non-limiting example, multiple colors, card-suit patterns (e.g., hearts, diamonds, spades, clubs), casino logos, thematic logos (e.g., palm trees or dollar signs), and the like. Balls are picked until a winning player—or winning players—achieve(s) a pattern on their players card(s) that matches the predetermined winning sequence. Two payouts are available: (1) a traditional payout for achieving the winning sequence; and (2) an enhanced payout for both (a) achieving the winning sequence and (b) having the last ball that was called come from the colored, or otherwise marked or designated, set of balls. If the winning player is eligible for the enhanced payout, then the jackpot amount may be increased according to the total number of colored, or otherwise marked or designated, balls that the winning player had in the winning player's winning sequence.

In one embodiment, the buy-in may be made using casino chips. In alternative embodiments, the buy-in may be made using another currency (e.g., cash). In other embodiments, a pack of players cards may be purchased and the prize of the price for players seeking to join the bonus game may be increased. Furthermore, in other embodiments, the price may be further increased for those players that request access to a progressive jackpot.

In certain embodiments described herein, the game may be a live game played with a hopper operated by an actual game administrator in a casino. But certain other embodiments described herein may not be limited to play at a physical location with actual balls. Such embodiments may be played online or incorporated into an electronic gaming machine or automated gaming system. For example, the game of one embodiment may be played at a video monitor that displays virtual players cards and virtual balls or other objects numbered and designated. "Virtual balls" may refer to a data equivalent to a physical ball, as used in an electronic implementation of the game.

Figure 2:
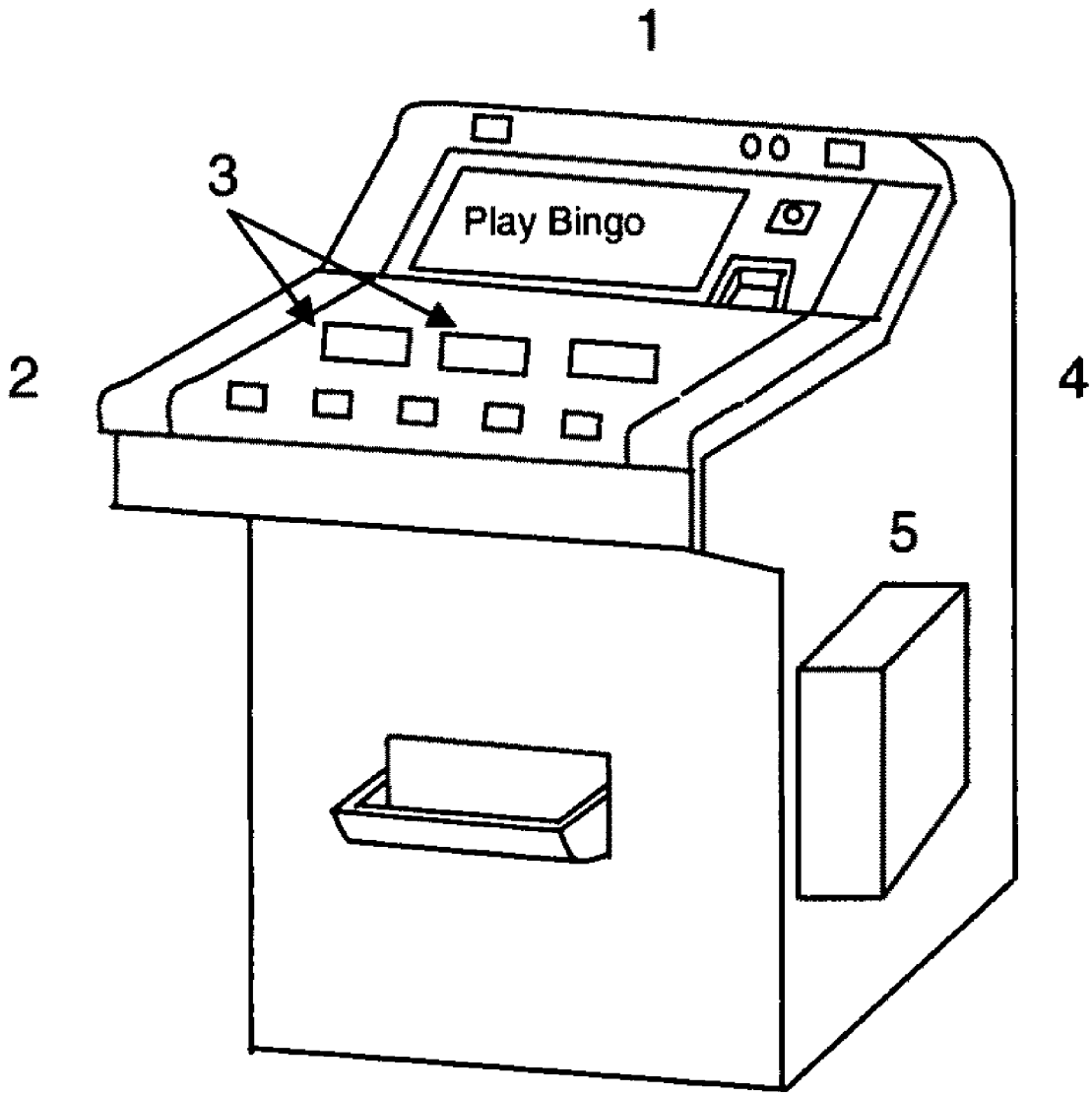
FIG. 2 shows a device for playing a game according to one or more embodiments of the present invention.

As shown in FIG. 2, another embodiment of the present invention may include a device for performing methods of playing games as described in embodiments herein, e.g., playing a modified form of Bingo. The device 4 may include a display 1 and a player input interface 2 that includes at least a principal bet selector and a buy-in bet selector 3 (e.g., buttons, or touch-screen regions, or the like). The device 4 may house or be in communication with, e.g., in network connection with, a computer processor 5 in communication with the display and the player input interface 2. The processor 5 may be configured to store in a memory data and/or instructions (e.g., data descriptive of at least one Bingo card), and to execute software or other processes necessary to perform the method and game embodiments described herein (e.g., drawing or otherwise revealing in sequence virtual Bingo balls, etc.). The computer processor 5 also may be configured to execute software or other processes that allow the device to accept a wager from a player on (i) the underlying Bingo game, (ii) the bonus aspect of the modified Bingo game of the embodiments disclosed herein, or (iii) both (i) and (ii).

In another embodiment, the computer processor 5 may also be configured to execute software or other processes that designate a predetermined winning sequence, permit a player to view the winning sequence and balls, or other similarly numbered and designated objects, as they are called, notify player if the player achieved the winning sequence, and calculate for the winning player of the jackpot(s) that the winning player(s) received. The computer processor 5 may be programmed to allocate the jackpot to the winning player through a ticket representing a form of currency, casino chips, or some other manner of transferring jackpot winnings.

Figure 3:
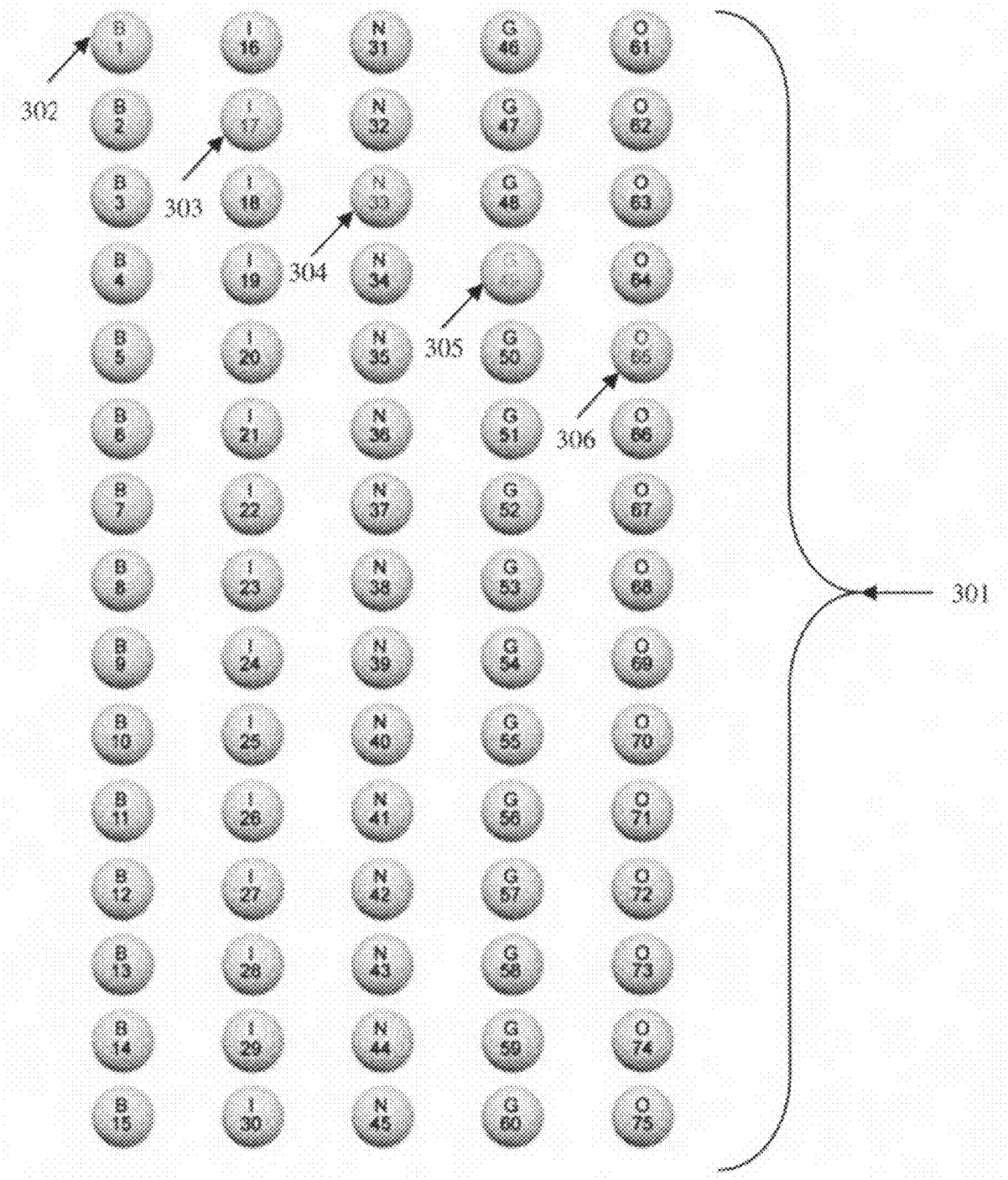
FIG. 3 shows a set of real or virtual balls with a subset of colored balls.

As shown in FIG. 3, an embodiment of the present invention may have a set of real or virtual balls 301 that includes a subset of colored balls 302 303 304 305 306.

Players may find a modified version of Bingo according to the described embodiments more enjoyable than traditional Bingo because the player is able to make an additional wager and potentially receive and additional and enhanced payout. This may give players a greater interest in the game and add to a sense of excitement for the game. Casino and other game operators may also welcome this new form of Bingo because it may attract additional players.

Although illustrative embodiments have been shown and described herein in detail, it should be noted and will be appreciated by those skilled in the art that there may be numerous variations and other embodiments that may be equivalent to those explicitly shown and described. For example, the scope of the present invention is not necessarily limited in all cases to execution of the aforementioned steps in the order discussed. Unless otherwise specifically stated, terms and expressions have been used herein as terms of description, not of limitation. Accordingly, the invention is not to be limited by the specific illustrated and described embodiments (or the terms or expressions used to describe them) but only by the scope of claims.

We claim:

1. A method of operating a Bingo game, comprising:

providing each of one or more players with a player card having a randomly assigned field of spaces each space of which comprises a number within a predetermined numerical sequence;

assigning at least one subset of the spaces as a first winning criteria;

randomly selecting at least one ball from a first set of balls and presenting it to the one or more players, wherein each of the first set of balls has been assigned a number selected from a group within the predetermined numerical sequence, and wherein there are fewer spaces on each player card than numbers in the predetermined numerical sequence given for the first set of balls;

repeatedly and randomly selecting another one of the balls from the first set and presenting it to the one or more players until the first winning criteria is satisfied for at least one of the players, wherein the final one of the balls selected is among the balls that comprise the first winning criteria;

awarding the player a first prize corresponding to the first winning criteria; and awarding the same player that was awarded the first prize a second prize if the final one of the balls selected from the first set is among a second set of balls, wherein the second set of balls within the predetermined numerical sequence has been assigned a non-numerical designation, and wherein the second set of balls includes one or more balls that is a subset of the first set of balls.

2. The method of claim 1, wherein the non-numeric designation comprises a color.

3. The method of claim 2, wherein the second subset of balls comprises balls each having a different color, wherein a value of the second prize depends upon the color of the ball that caused the first winning criteria to be satisfied.

4. The method of claim 1, wherein the predetermined numerical sequence comprises 1-75 and the second subset of balls comprises five balls.

5. The method of claim 4, wherein a first ball of the second subset of balls is selected from the numerical sequence 1-15, a second ball of the second subset of balls is selected from the numerical sequence 16-30, a third ball of the second subset of balls is selected from the numerical sequence 31-45, a fourth ball of the second subset of balls is selected from the numerical sequence 46-60, and a fifth ball of the second subset of balls is selected from the numerical sequence 61-75.

6. The method of claim 1, wherein assigning the non-numerical designation to the second set of balls within the predetermined numerical sequence further comprises systematically selecting the number for each of the second set of balls from the predetermined numerical sequence and disclosing those numbers to the one or more players before commencement of the game.

7. The method of claim 1, further comprising calculating the second prize from a pay table.

8. The method of claim 7, wherein the pay table is predetermined by a game operator and disclosed to the one or more players.

9. The method of claim 1, further comprising requiring the player to place a first wager to qualify for winning the first prize and a second wager to qualify for winning the second prize.

10. The method of claim 1, wherein a maximum value of the second prize grows progressively each time the first winning criteria is satisfied but the maximum value of the second prize is not awarded.

11. A device for operating a Bingo game, comprising:

a player input interface comprising a bet selector; and a computer processor in communication with the player input interface, wherein the processor is configured to:

assign to each of a first set of virtual balls a number selected from a group within a predetermined numerical sequence;

assign a non-numerical designation to only a second set of virtual balls within the predetermined numerical sequence, wherein the second set of virtual balls is a subset of the first set of virtual balls;

assign each of one or more players with a virtual player card having a randomly assigned field of spaces each space of which comprises a number within the predetermined numerical sequence, wherein there are fewer spaces than numbers in the predetermined numerical sequence given for the first set of virtual balls;

assign at least one subset of the spaces as a first winning criteria;

randomly select at least one of the virtual balls from the first set and present it to the one or more players;

repeatedly and randomly select another one of the virtual balls from the first set and present it to the one or more players until the first winning criteria is satisfied for at least one of the players, wherein the final one of the balls selected is among the balls that comprise the first winning criteria;

award the player a first prize corresponding to the first winning criteria; and awarding the same player that was awarded the first prize a second prize if the final one of the virtual balls selected from the first set is among the second set of virtual balls.

12. The device of claim 11, wherein the non-numeric designation comprises a color.

13. The device of claim 12, wherein the second subset of virtual balls comprises balls each having a different color, wherein a value of the second prize depends upon the color of the ball that caused the first winning criteria to be satisfied.

14. The device of claim 11, wherein the predetermined numerical sequence comprises 1-75 and the second subset of virtual balls comprises five balls.

15. The device of claim 14, wherein a first ball of the second subset of virtual balls is selected from the numerical sequence 1-15, a second ball of the second subset of balls is selected from the numerical sequence 16-30, a third ball of the second subset of balls is selected from the numerical sequence 31-45, a fourth ball of the second subset of balls is selected from the numerical sequence 46-60, and a fifth ball of the second subset of balls is selected from the numerical sequence 61-75.

16. The device of claim 11, wherein assigning the non-numerical designation to the second set of virtual balls within the predetermined numerical sequence further comprises systematically selecting the number for each of the second set of balls from the predetermined numerical sequence and disclosing those numbers to the one or more players before commencement of the game.

17. The device of claim 11, further comprising calculating the second prize from a pay table.

18. The device of claim 17, wherein the pay table is predetermined by a game operator and disclosed to the one or more players.

19. The device of claim 11, wherein the computer processor is further configured to require the player to place a first wager to qualify for winning the first prize and a second wager to qualify for winning the second prize.

20. The device of claim 11, wherein a maximum value of the second prize grows progressively each time the first winning criteria is satisfied but the maximum value of the second prize is not awarded.

* * * * *